United States Patent [19]

Koch, Jr. et al.

[11] 4,362,118

[45] Dec. 7, 1982

[54] SELF-LATCHING HATCH COVER FOR BARGES

[75] Inventors: Robert C. Koch, Jr., Louisville, Ky.; Horst R. Hickmann, Cincinnati, Ohio

[73] Assignee: American Commercial Barge Line Co., Jeffersonville, Ind.

[21] Appl. No.: 243,742

[22] Filed: Mar. 16, 1981

[51] Int. Cl.[3] ..... B63B 19/14

[52] U.S. Cl. ..... 114/201 R; 16/348; 114/178; 114/203; 220/335; 292/128; 292/256.5

[58] Field of Search ..... 114/201 R, 203, 176, 114/178; 49/394, 449, 336; 16/348, 291, 202; 292/216, DIG. 49, 128, 228, 256.5; 105/377; 220/335, 326, 324

[56] References Cited

U.S. PATENT DOCUMENTS

| | | | |
|---|---|---|---|
| 722,215 | 3/1903 | DeRusett | 114/201 R |
| 2,003,835 | 6/1935 | Mitchell | 16/348 X |
| 2,865,668 | 12/1958 | Krause | 292/216 |
| 3,112,514 | 12/1963 | Ostrom | 16/292 X |
| 3,696,774 | 10/1972 | Ostrem | 114/203 |
| 3,730,128 | 5/1973 | Burwell | 114/201 |
| 3,987,516 | 10/1976 | Winsor | 16/143 |

FOREIGN PATENT DOCUMENTS

| | | | |
|---|---|---|---|
| 52175 | 10/1941 | Netherlands | 114/178 |

*Primary Examiner*—Sherman D. Basinger
*Attorney, Agent, or Firm*—Laurence R. Brown

[57] ABSTRACT

A cast aluminum hatchway cover has projecting hinge structure for mating with a hinge housing part affixed on a hatchway coaming. The hinge is detented for holding the cover in closed, partly open and fully open posture. Self-latching lock structure has a foot operable unlocking lever outside the hatchway and an emergency unlocking lever inside the hatchway. The hinge detenting mechanism comprises cams with mating elements located respectively on the cover and hinge housing part.

9 Claims, 7 Drawing Figures

SELF-LATCHING HATCH COVER FOR BARGES

TECHNICAL FIELD

This invention relates to barges and the like and more particularly it relates to hatch covers.

BACKGROUND ART

Light weight hinged covers for barge hatches have been proposed in U.S. Pat. No. 3,730,128—R. P. Burwell—May 1, 1973. However, they are a part of a rounded top fiber glass barge cover assembly and are not adapted to the normal routine of a long haul barge where personnel must walk the deck and inspect hatches, etc. The round top is not safe for personnel under slippery, wet or heavy seas conditions. Thus, such construction is not adapted for inspection en route of cargo via hatch covers, nor for loading of rugged bulk cargos such as coal because of the limited strength and ruggedness of the construction and the inability of the hatch cover to conform to all required conditions including receiving the heavy impact of a load or loading mechanism during loading, keeping water out of the cargo maintaining the hatch covers in secure open or closed condition during loading and voyage, etc.

One feature desired on a hatch cover is a quick release latch that will hold the cover in a closed condition resisting entry of water and yet is rugged enough to withstand rough handling during use and loading. A manually operable latch is shown in U.S. Pat. No. 3,987,516—R. B. Winsor et al.—Oct. 26, 1976. However, the structure is such that it may be damaged or made inoperative by accumulation of cargo such as coal lumps or by impact during cargo loading. Also, it is difficult to manufacture and uses a lot of space providing an impediment to deck space use and also possible hazards to personnel particularly when in rough seas. The construction is not adaptable to retention of the cover in place and also in open position secured for impact during loading or partly open for inspection of the cargo.

Automatic hatch cover latching is accomplished in the prior art by such means as a hydraulic cylinder operated latch as shown in U.S. Pat. No. 3,696,774—H. Ostrem—Oct. 10, 1972. However, not only is it difficult and expensive to provide such power sources on barges, but the hatches are not accessible during power outages, and are not operable manually in a fail-safe mode.

Accordingly, it is an objective of this invention to provide improved light weight hatch cover assemblies suitable for rugged use on barges and the like, accessible at all times by deck hands for opening to inspect the cargo, and retaining the cover in open position for loading and water entry resistant closed condition for transit.

Other objects, features and advantages of the invention will be found throughout the remaining description, the drawing and the claims.

DISCLOSURE OF THE INVENTION

This invention provides a light weight cast aluminum, hinged, self-latching hatch cover mounted with a water repellant seal in closed position about a coaming surrounding a barge hatchway. All hardware for hinging and latching is closely confined to the vicinity of the coaming to avoid blocking deck space or using members that could endanger a deck hand under heavy sea or slippery deck conditions.

The self-locking latch holding the cover closed against the water repellant seal has two unlocking release levers, one a foot operated member outside the coaming and the other an emergency lever inside the hatchway.

The hinging structure provides detenting for holding the cover in closed, partly open and fully open positions for transit, inspection and loading activities. The hinge is mounted by an open top housing member affixed to the coaming for receiving therein an integral projection hinge member extending from the cover. The housing and the projection provide cam elements for both detenting and confining the lid position close to the hatchway coaming so that little deck space is encumbered in the open cover position.

The entire assembly is made light weight for barge weight efficiency and for simple operation by one deck hand, who can readily and efficiently open or close the cover in a quick opening or self-latching mode. The entire assembly is rugged enough for rough barge loading conditions, is sealed for water resistant transit while fully compatible with cargo inspection during transit and without compromise to time effectiveness and safety of deck hands.

THE PREFERRED EMBODIMENT OF THE INVENTION

Figure 1:
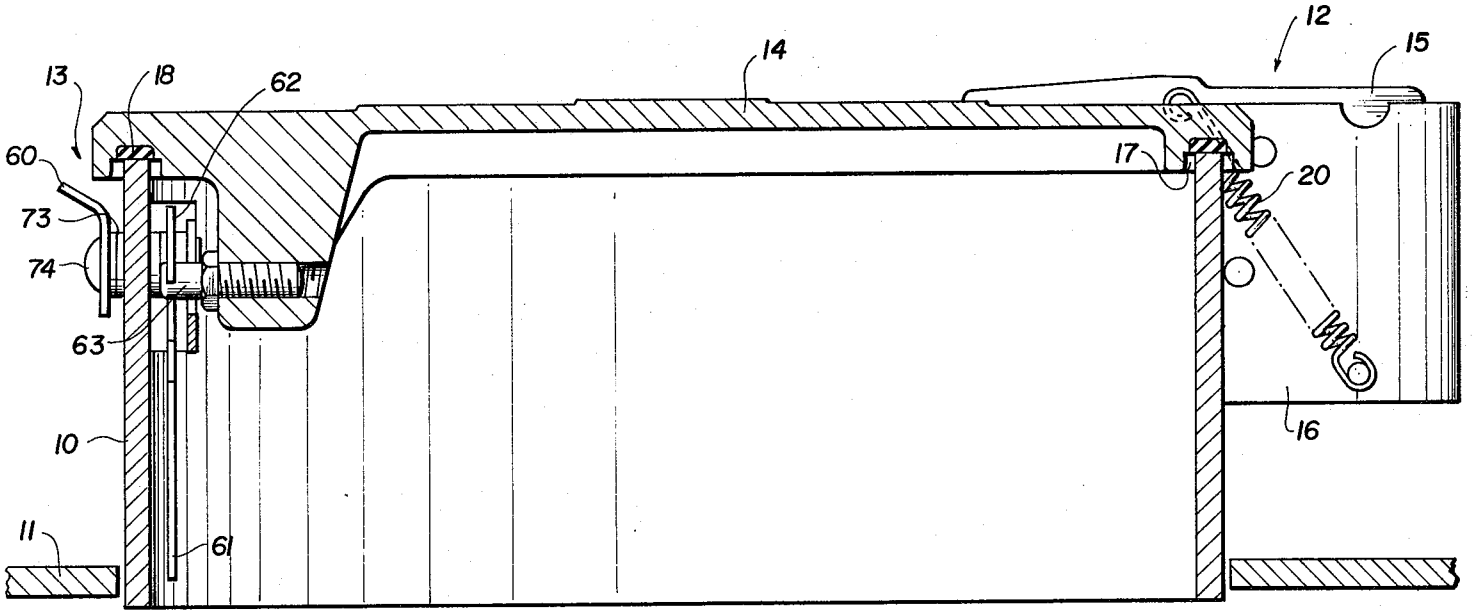
FIG. 1 is an elevation view, partly in section of a hatch cover afforded by the invention latched in closed condition on a hatchway coaming.

As may be seen in FIG. 1, a hatchway coaming 10, generally elliptical in shape, is cut away to show the barge deck 11 in which it is located, preferably by welding. The view shows one of the two hinging structures 12 and the latching structure 13 in profile view.

The hatchway cover 14 is of cast aluminum, which reduces weight from about 100 pounds for steel to 18 pounds and permits a single deck hand to simply manipulate the cover. It has two integral hinge member projections extensions 15 which mate into open top housing structure 16 affixed as by welding into coaming 10.

For making the cover in its shown closed condition substantially watertight, it has a groove 17 registering with the top ring of coaming 10 which contains the corrugated cast-in-place seal member 18 in compression contact with the coaming rim. The corrugations engaging the rim aid in making this water resistant seal substantially watertight.

The hinge structure 12 has a spring 20 engaging the cover 14 and housing 16 at opposite ends to provide a bias force holding the cover 14 closed in the shown position, and as later described, holding the cover 14 open in opened position.

Figure 2:
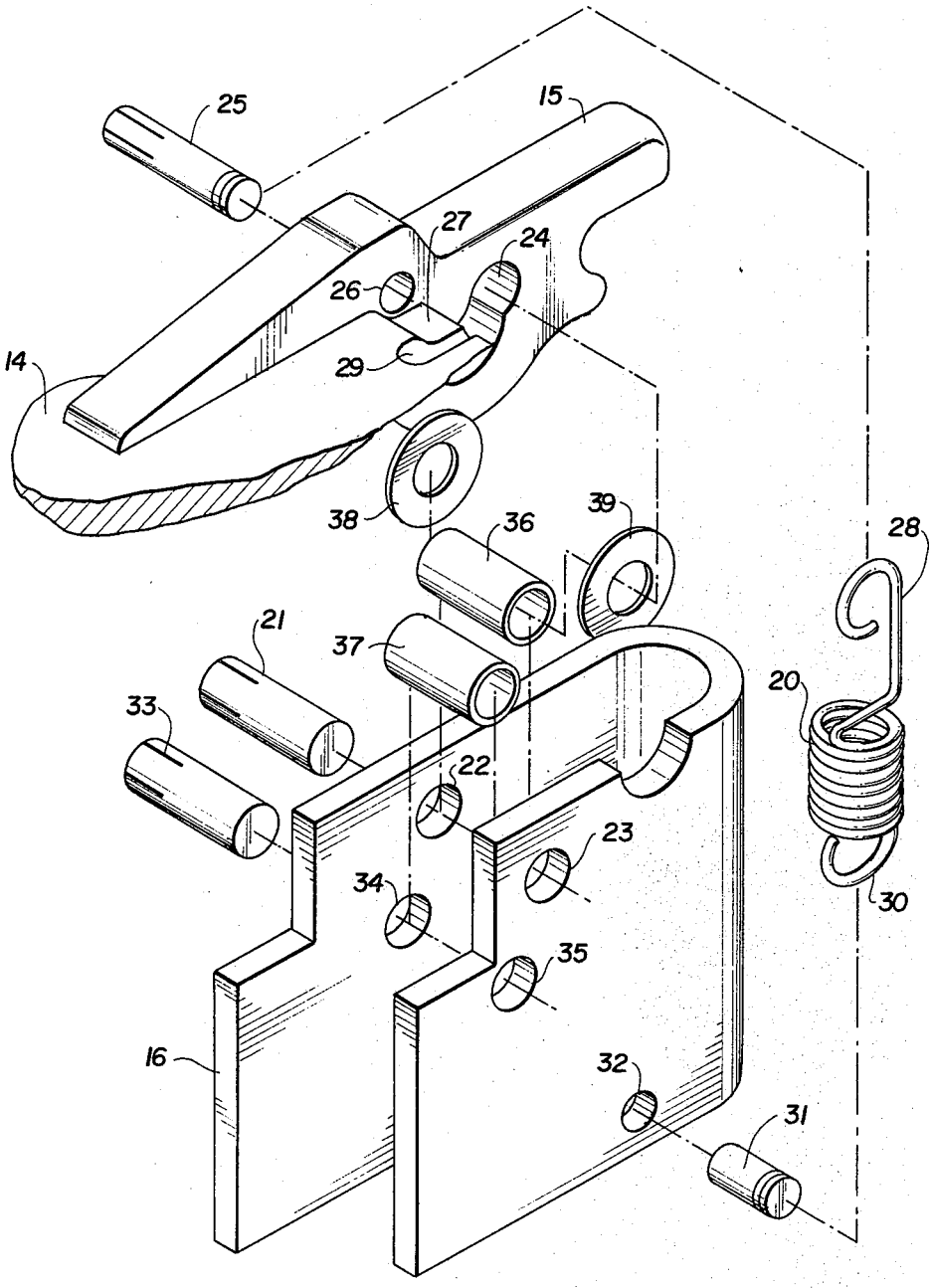
FIG. 2 is an exploded assembly perspective view of the hinging structure provided by this invention.

The assembly and operation of the hinging structure may be understood more clearly by reference to FIGS. 2 and 3 showing respectively the exploded relationship of assembly parts and the action of the hinge as a cam-detent mechanism in opening and closing.

It is important that the hinge projection 15 when mated into the open top of hinge housing 16 fits tightly, to prevent the accidental wedging of pieces of coal, etc. from cargo loading, which would affect operation.

The cover 14 is attached to the coaming by means of a single pin 21 on each hinge assembly (12) seated in the hinge housing apertures 22, 23, and extending through the aperture 24 in the cover hinge projection member 15. This permits the cover 14 to pivot from open to closed positions.

The spring 20 at one end is retained on pin 25 held in aperture 26 on the cover. The pin 25 extends from aperture 26 in groove 27 and spring end 28 nests in slot 29 in operation (as shown in FIG. 1). The opposite end 30 of spring 20 engages pin 31 seated in aperture 32 on housing 16. The spring 20 is replaced by a spring axis line 20' in the FIGS. 3A to 3D views for purposes of clarity.

A cam pin 33 is fitted into apertures 34, 35 of housing 16. Since pins 21 and 33 are preferably steel, as is hinge housing 16, they are surrounded by shim rollers 36, 37 respectively for reducing frictional wear on the softer aluminum cover projection 15. Washers 38, 39 space the hinge extension 15 of cover 14 centrally within the open top of housing 16.

Figure 3A:
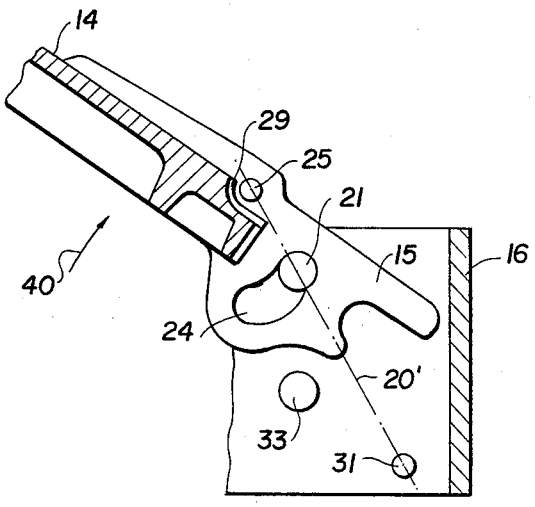
FIGS. 3A through 3D are fragmental views, partly in section, showing the operation of the hinge detent mechanism in various hatch cover open positions.
Figure 3B:
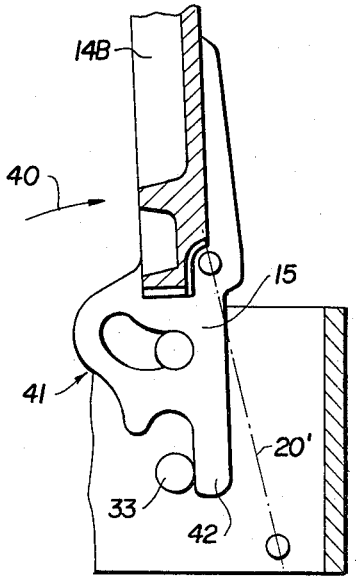
Figure 3D:
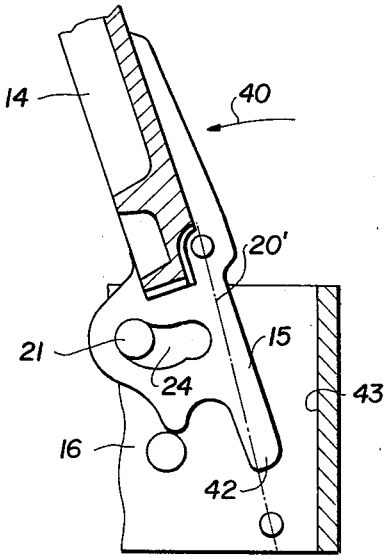
Figure 3C:
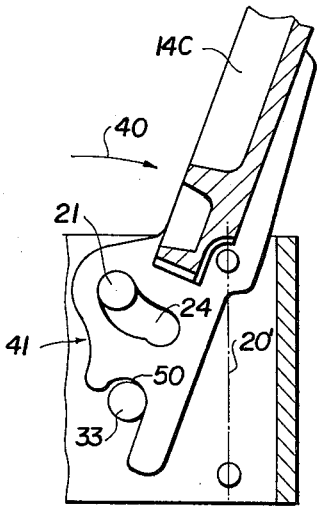

The hinge action is best seen from FIG. 3, wherein the arrow 40 indicates the direction of cover travel, toward open position in FIGS. 3A, 3B and 3C and toward closed position in FIG. 3D.

It is seen from survey of the FIG. 3 views that a complex camming action takes place along several camming surfaces. Thus, pin 21 rides in slot 24 for one camming relationship. Pin 33 rides along the contoured lower surface 41 of the hatch cover projection 15 for another camming relationship. A third camming action occurs as the point 42 of the cover projection 15 engages the rear wall 43 of the U-shaped hinge housing member 16.

The pin 21 is by the camming action seated in the small right hand end of the cam slot 24 as shown in FIGS. 3A and 3B when the hatch cover is closed, and when first moving away from the closed position in those Figures.

Because of the size and shape of aperture cam-slot 24 it is seen that the hatch cover 14 opens within a hinging action space close to the edge of the coaming. Also, when in its fully open position (FIG. 3C) fully clears the hatchway coaming without interfering with loading but need not be removed and without covering or interfering substantially with deck space about the coaming.

The hatch cover 14 has a partly open detented position as shown in FIG. 3B and a fully open detented position shown in FIG. 3C. The former permits a "quick" inspection look into the hold or hatchway and the latter permits loading or unloading without interfering with the hatchway opening.

As the cover 14 opens through the FIG. 3A position, the tip 42 of the projection 15 engages pin 33 to provide a detented stop position for the partly open cover 14B.

It is noted that the spring (20') goes over a dead center position from FIG. 3A where its bias tends to close cover 14 to the FIGS. 3B and 3C positions where the spring biases the cover 14 into the open position.

If more manual torque in the opening direction is applied to cover 14 when in the FIG. 3B position the slot 24 engages pin 21 in its leftmost limit position shown in FIG. 3C and the groove 50 on cam surface 41 rides down onto pin 33 to hold the cover locked into a secure fully opened detent position 14C that withstands considerable force expected during loading operations.

When a counterclockwise force 40 is applied to cover 14 from its fully open detented position in FIG. 3C, the tip 42 of the cover hinge projection member 15 will engage the back wall 43 of the U-shaped open top hinge housing 16 in a cam action that causes the cam slot 24 in the cover 14 to move relative to pin 21 back into the closing position to the left shown in FIGS. 3A and 3B. Also, when spring 20' snaps back over its dead center position it serves to close the cover 14 on its seal as shown in FIG. 1.

Figure 4:
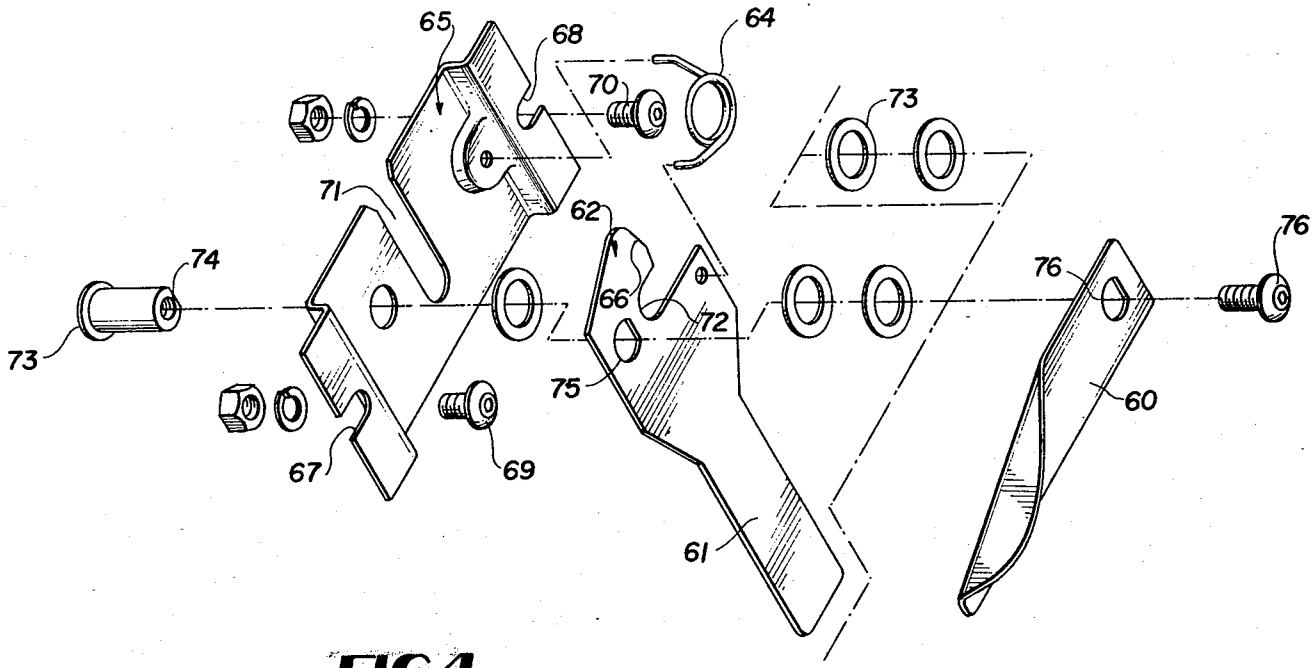
FIG. 4 is an exploded assembly perspective view of the latching structure provided by this invention.

The self latching feature 13 (FIG. 1) of this invention is better understood by reference to the assembly view of FIG. 4. From FIG. 1 it is seen that there is a foot operable unlocking lever 60 outside the coaming 10 and a manually operated emergency lever 61 inside the hatchway. The movable latch 62 mates with and locks over a stud bolt lock member 63 engaging the cover 14. This latch is moved against the force of a closure biased spring 64 engaging a frame member 65 and the latch member 62.

Thus, three members will serve to move latch member 62 against the closure bias of spring 64, namely the emergency lever 61, the foot lever 60 and the cover bolt 63 camming against surface 66.

Therefore it is seen from the assembly view of FIG. 4 that the frame member 65 is affixed to the coaming (10) by slots 67, 68 and bolts 69, 70. The bolt guiding slot 71 registers the cover bolt 63 in position for camming against surface 66 as it enters the slot to ride the latch member 62 to the left as shown in the drawing to mate the cover bolt (63) into groove 72.

The five washers 73, etc. are assembled as shown in FIG. 1 about pivot bolt 73 with flattened face 74 mating into apertures 75, 76 respectively on the latch member 62 and foot lever 60. Keeper bolt 76 completes the latch assembly so that either rotation of the emergency handle 61 or the foot treadle 60 will back slot 72 away from the cover bolt and permit it to spring open, in part because of the resilience of the seal 18.

It is clear therefore that a novel self-latching hatch cover provides the special needs and circumstances not heretofore made available for hatch covers for barges and the like. Accordingly, those novel features believed descriptive of the spirit and nature of this invention are defined with particularity in the claims.

INDUSTRIAL APPLICATION

A self-latching light weight cast aluminum leak resistant hatchway cover for closing a hatchway coaming on a barge or the like is hinged to detent in fully open, partly open and closed positions. It is quickly operable by a single deck hand. A foot operated unlocking latch lever permits operation from the deck, and an emergency unlocking latch release extends inside the cover into the hatchway. The partly open position may be used for inspection and the fully open position for loading.

The cover may be positioned close to structures such as railings or walls or even with overhead interfering structures since it is detented open partly in a position confined within its coaming dimensions, thereby letting deck hands walk adjacent its coaming, and permitting access without being fully opened. Also, it is easily and quickly opened and closed manually saving time and trouble.

I claim:

1. A water tight hatch cover and coaming assembly on a barge or like vessel, comprising in combination, a manually operable cover adapted to selectively close a hatchway defined in part by the coaming assembly to keep water out and to open it for access to a cargo area, hinging means hinging the cover on the coaming assembly to move from open to closed hatchway positions thereon including a projection on said cover extending beyond the coaming and a substantially U-shaped open topped mating housing member extending from the coaming to surround the extension, a detent slot defined in said extension disposable in said housing member over the movement span of the cover, a pin extending through the housing member to engage the slot and seat in different detent positions therein for open and closed cover positions, means camming the projection against the housing member as the cover moves from an open to a closed position to move the cover slot from one detent position to another, and a quick release self-latching spring loaded lock for retaining said cover in a water tight closed position thereby permitting a deck hand to quickly open and close the hatch cover.

2. A hatch cover as defined in claim 1 wherein the lock has a manually operable safety release lever accessible to a deck hand within the hatchway to permit the deck hand to open the hatch and emerge from a closed hatchway.

3. A hatch cover as defined in claim 1 wherein the lock has a release lever mounted adjacent the cover outside the hatchway and is adapted for foot operation to release the lock.

4. A hatch cover as defined in any one of claims 1 to 3 wherein said hinging means assembly has a structure portion affixed to said cover adapted to mate with structure affixed to the housing member thereby to detent the cover in both a partially open and fully open posture respectively to permit inspection and cargo handling through the hatchway.

5. A hatch cover as defined in claim 1 constructed of cast aluminum, with an integral portion of the hinging means extending therefrom to form said detent slot to secure the cover in open position thereby to facilitate manual manipulation, provide a greater cargo payload capacity and reduce the likelihood of unscheduled closure upon impact.

6. A hatch cover as defined in claim 1 having two sets of hinging means and one lock positioned about the coaming periphery.

7. A hatch cover as defined in claim 1 including a second detent pin and further camming structure on the projection mating with the second detent pin to engage it when the cover is partly open thereby causing the first detent pin to move to a different detent position in said detent slot.

8. A hatch cover as defined in claim 1 wherein the projection closely fits in the U-shape of the open top housing member to thereby prevent accumulation of debris during loading or unloading of cargo that might interfere with the hinging of the cover.

9. A hatch cover as defined in claim 1 including a plurality of detect cams in the hinging means structure adapted to detent the cover in closed, partly open and fully open positions.

* * * * *